US005639143A

United States Patent [19]

Ackerman

[11] Patent Number: 5,639,143

[45] Date of Patent: Jun. 17, 1997

[54] FOOT STOOL WITH FOOT WARMER

[76] Inventor: Timothy T. Ackerman, 14 Wilkenda Ave., East Haven, Conn. 06512

[21] Appl. No.: 533,548

[22] Filed: Sep. 25, 1995

[51] Int. Cl.[6] ..... A47C 7/50; A47C 7/72; A47C 16/00

[52] U.S. Cl. ..... 297/180.12; 297/423.14; 297/423.41; 297/423.44; 297/283.1; 601/16

[58] Field of Search ..... 297/180.12, 423.14, 297/423.41, 423.44, 188.1, 466, 283.1; 601/15, 16, 27

[56] References Cited

U.S. PATENT DOCUMENTS

| | | | |
|---|---|---|---|
| 1,460,915 | 7/1923 | Luton | 297/423.14 |
| 2,267,158 | 12/1941 | Locke | 297/423.14 |
| 2,587,731 | 3/1952 | Irving | 297/180.12 |
| 3,366,105 | 1/1968 | Sadowski et al. | 601/27 |
| 4,159,714 | 7/1979 | Peterson et al. | 601/15 |
| 5,466,041 | 11/1995 | Hoffman et al. | 297/188.1 |

*Primary Examiner*—Peter M. Cuomo
*Assistant Examiner*—Anthony D. Barfield

[57] ABSTRACT

A foot stool with a top that opens up and has a foot warming device fastened to the underside of the top. The top is hinged to one side of the foot stool and opens up to a point where the top is at an angle to the side it is hinged to. At this point the users feet can be inserted into the foot warmer and the feet will be at a comfortable position. When the foot warmer is not in use it is stored inside of the foot stool when the top is in the closed position.

1 Claim, 3 Drawing Sheets

FIG. 1
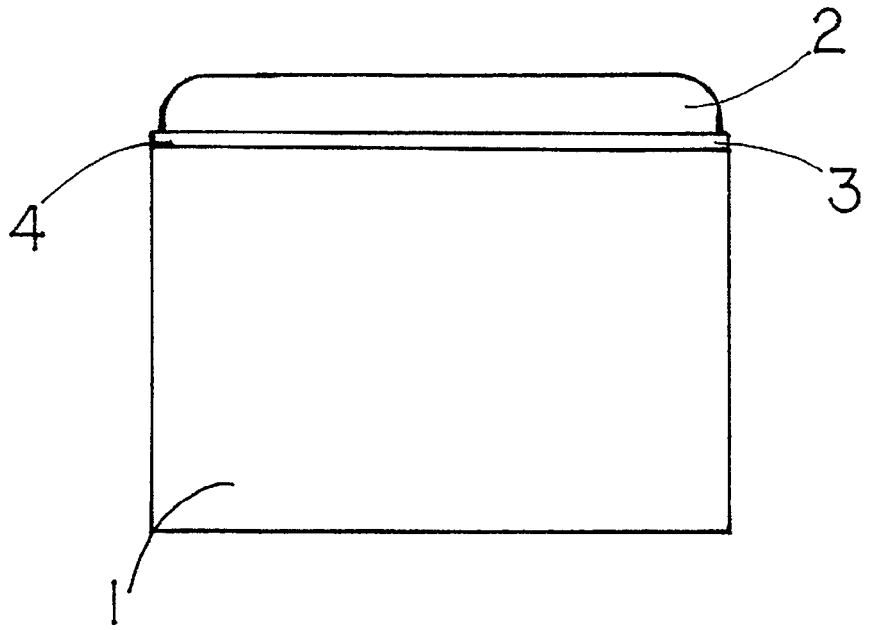
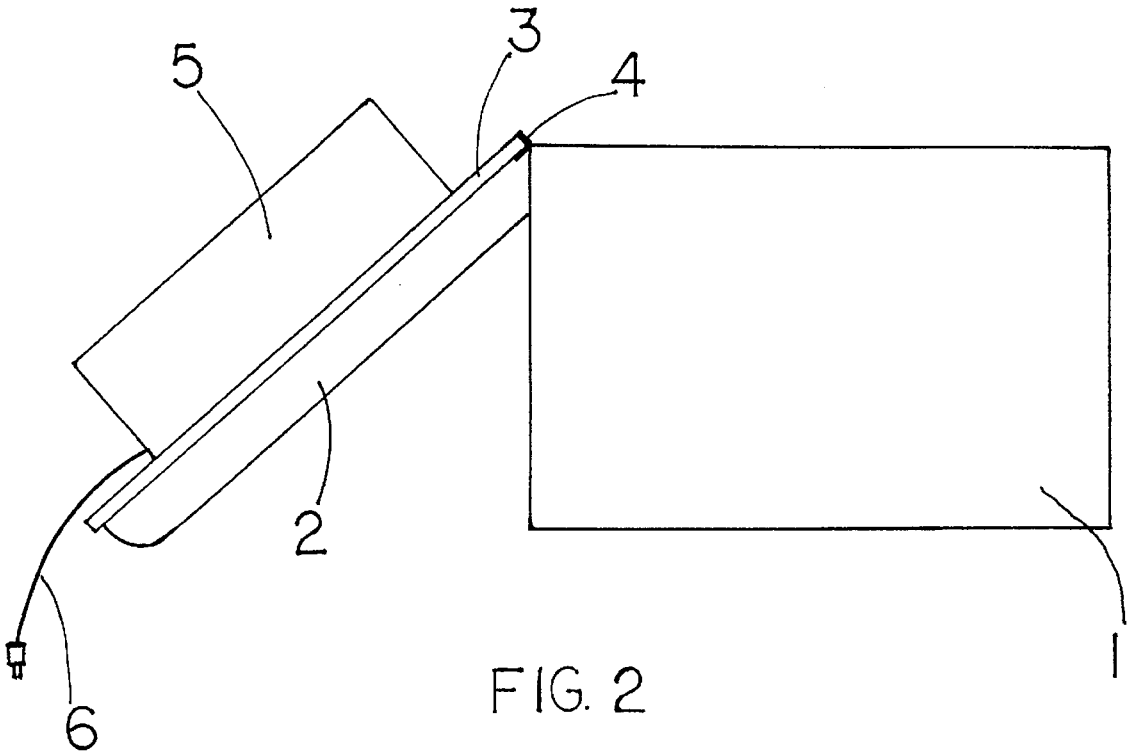
FIG. 2

FIG. 4
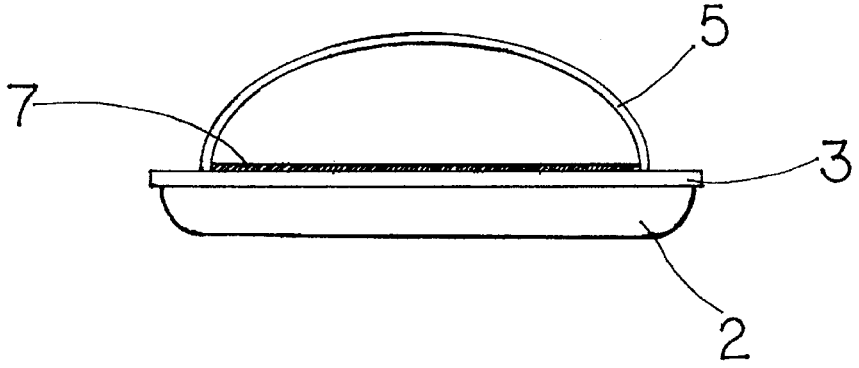
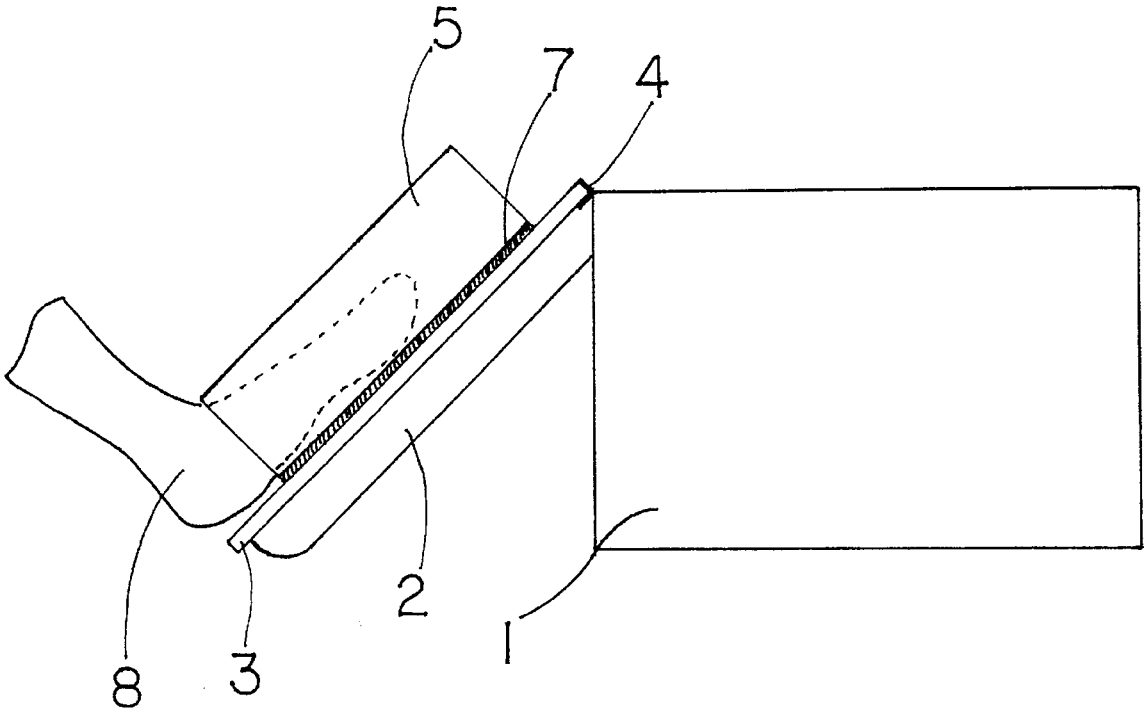
FIG. 5

FOOT STOOL WITH FOOT WARMER

BRIEF SUMMARY OF THE INVENTION

The invention consists of a foot stool with a built in foot warmer. The top of the stool is where the feet are rested when the invention is being used as a foot stool. The top of the stool is hinged on one side so that the top opens up and when fully opened rests at an angle to the side of the stool. On the underside of the top of the stool is a foot warmer. The foot warmer operates on household current and plugs into an electrical outlet. The feet are inserted in the warmer where they are kept warm by a heating device.

BRIEF DESCRIPTION OF THE DRAWINGS

In the drawings:

FIG. 1 is a side view of the foot stool with its top in the closed position.

FIG. 2 is a side view of the foot stool with the top fully open and in position to be used as a foot warmer.

FIG. 4 is a view of the foot warmer showing the area where the feet are inserted.

FIG. 5 is a side view of the foot stool with the top in the fully open position and the feet inserted in the foot warmer.

DETAILED DESCRIPTION OF THE INVENTION

Figure 3:
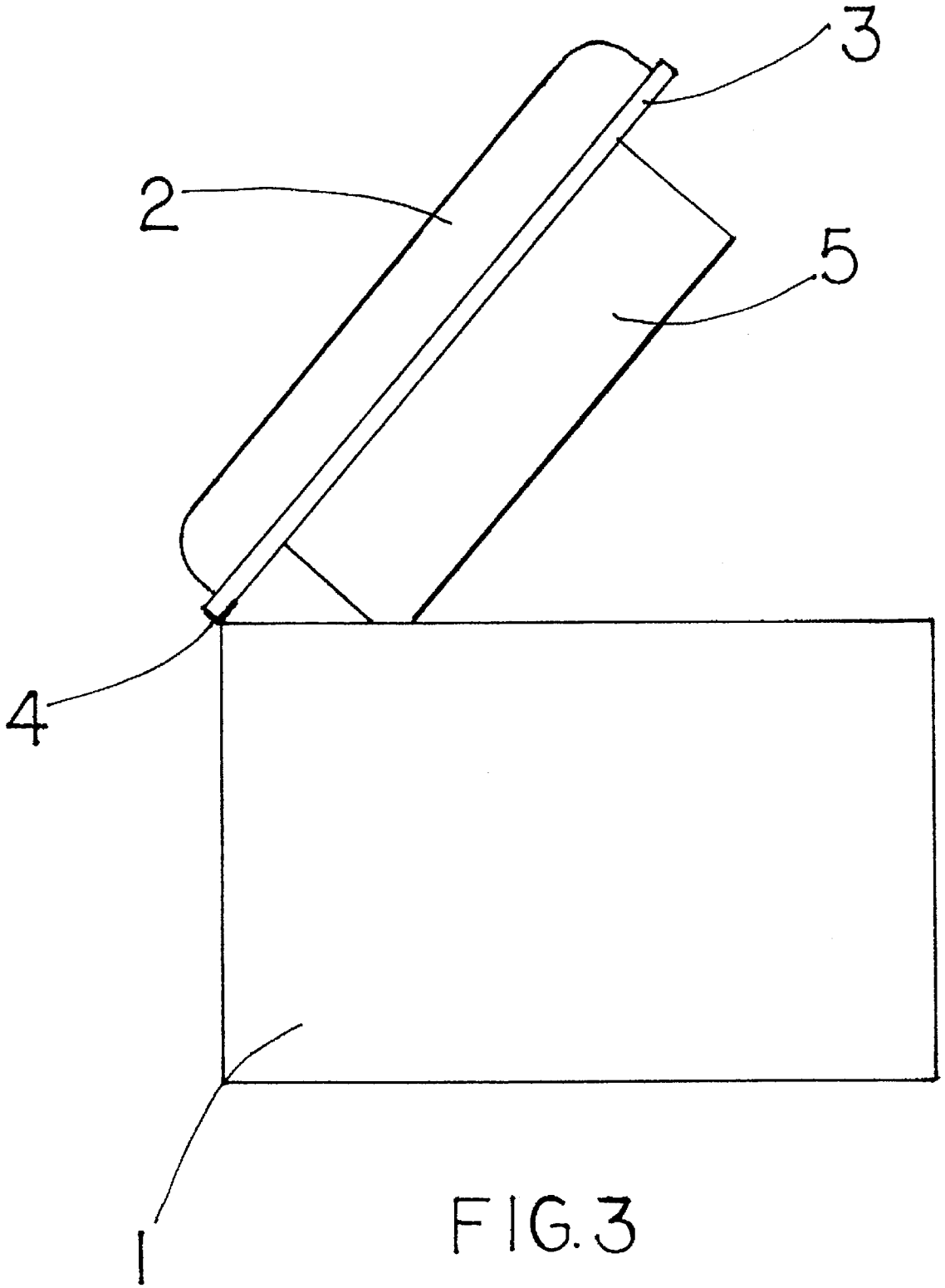
FIG. 3 is a side view of the foot stool with the top in a partially open position.

Referring now to FIGS. 1–5,

In FIG. 1 the invention is shown as being composed of a foot stool with four sides 1, the top 3, which is attached at one side with hinge 4 and the padded topping 2. When the invention is being used as a foot stool the feet are rested on the padded topping 2.

In FIG. 2 the invention is shown with its top 3 in the fully open position ready to be used as a foot warmer. The top 3 is attached at one end to one of the four sides 1 by hinge 4. The foot warmer 5, is located on the underside of the top 3 and is exposed when the top 3 is lifted and pivoted to its open position. The foot warmer is electrically operated and receives power by input cord 6.

In FIG. 3 the invention is shown with its top in a partially open position showing how the foot warmer 5 is stored inside of the foot stool. The warmer 5 is fastened to the underside of the top 3. Top 3 is fastened to one side 1 of the footstool by hinge 4.

In FIG. 4 the foot warmer is shown. The feet are inserted between the heating device 7 and the foot warmer 5. The warmer is made of a pliable material such as fabric so that it conforms to the shape of the feet and keeps heat in the area of the feet.

In FIG. 5 the top 3 is shown in its fully open position and being used to warm the feet. In the fully open position the top is at an angle to the side that it is hinged to. The feet 8 are shown inserted between the warmer 5 and the heating device 7.

While I have described my invention with particular reference to the drawings, such is not to be considered as limiting its actual scope.

Having thus described this invention, what is asserted as new is:

1. A foot stool comprising:

(a) a base with four sides which rests on an underlying surface;

(b) a top is hinged to one of the sides whereby the top will open by pivoting on a hinge to a fully open position where the top will come to rest with an underside of the top being adapted to face a user and the underside of the top being at a 200 degree to 230 degree angle relative to a normally closed position of the top engaged with the sides;

(c) A foot warmer which is attached to the underside of the top and is stored inside the foot stool when the top is in the closed position and when the top is in the fully open position the foot warmer is adapted to face the user; the foot warmer comprising a pliable material adapted to cover feet of the user and an electrically operated heating device adapted to warm the feet when being rested thereupon.

* * * * *